US010549968B2

(12) United States Patent
De Matos

(10) Patent No.: US 10,549,968 B2
(45) Date of Patent: Feb. 4, 2020

(54) INTEGRATED WORKSTATION IN WELL SURFACE EQUIPMENT STRUCTURES

(71) Applicant: Schlumberger Technology Corporation, Sugar Land, TX (US)

(72) Inventor: Catrina De Matos, Roissy-en-France (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 111 days.

(21) Appl. No.: 15/838,596

(22) Filed: Dec. 12, 2017

(65) Prior Publication Data

US 2019/0177137 A1 Jun. 13, 2019

(51) Int. Cl.

| | |
|---|---|
| ***B66D 1/12*** | (2006.01) |
| ***E21B 19/00*** | (2006.01) |
| ***B66D 3/26*** | (2006.01) |
| ***B66D 1/42*** | (2006.01) |

(52) U.S. Cl.

CPC ..... *B66D 3/26* (2013.01); *B66D 1/12* (2013.01); *B66D 1/42* (2013.01); *E21B 19/008* (2013.01)

(58) Field of Classification Search

CPC ..... E21B 19/008; B66D 3/26
USPC ..... 166/244.1
See application file for complete search history.

(56) References Cited

U.S. PATENT DOCUMENTS

2003/0196815 A1* 10/2003 Crawford ..... E21B 17/203 166/369
2015/0105914 A1* 4/2015 Wingky ..... G05B 19/0428 700/275
2016/0229672 A1* 8/2016 Breard ..... E21B 19/02

* cited by examiner

*Primary Examiner* — Taras P Bemko
(74) *Attorney, Agent, or Firm* — Eileen Pape

(57) ABSTRACT

Well servicing surface equipment and processes for making and using same. In some examples, the well servicing can include placing a winch module adjacent to a wellhead of the well such that a cable of the winch module is extendable into the well. A power module can be placed adjacent to the wellhead of the well. The power module can be configured to provide power to the winch module. A workstation can be deployed from a first configuration to a second configuration. The workstation can include a control panel and the control panel can be physically inaccessible by an operator when in the first configuration, and the control panel can be physically accessible by the operator when in the second configuration.

19 Claims, 5 Drawing Sheets

INTEGRATED WORKSTATION IN WELL SURFACE EQUIPMENT STRUCTURES

BACKGROUND

Field

Embodiments described generally relate to well servicing surface equipment and processes for making and using same.

Description of the Related Art

Oil and gas production service providers use equipment to analyze oil and gas wells to increase or maintain well production. Production services can include using acoustic energy to determine formation structures in the subterranean earth adjacent to the well. The acoustic energy analysis can be performed during the drilling of the well, which can be referred to as logging while drilling. The acoustic energy analysis can also be performed after the well has been drilled. Acoustic energy analysis tools can be lowered into the wellbore of the well from the surface of the wellsite using a cable. Surface equipment can communicate with the energy analysis tools in the wellbore for controlling the tool and/or for logging data gathered from the tool.

SUMMARY

Well servicing surface equipment and processes for making and using same are provided. In some examples, a process for servicing a well can include placing a winch module adjacent to a wellhead of the well such that a cable of the winch module can be extendable into the well. A power module can be placed adjacent to the wellhead of the well. The power module can be configured to provide power to the winch module. A workstation can be deployed from a first configuration to a second configuration. The workstation can include a control panel that can be physically inaccessible by an operator when in the first configuration, and can be physically accessible by the operator when in the second configuration.

In some examples, a power module can include a prime mover, and a generator for generating power that can be connected to the prime mover. A workstation can have a control panel that can be configured to receive power from the generator. The workstation can be configured to be deployed from a first configuration to a second configuration. The control panel can be physically inaccessible by an operator when in the first configuration, and the control panel can be physically accessible by the operator when in the second configuration.

In some examples, a winch module can include a cable, and a drum around which the cable can be disposed. The drum can be rotatable in a first direction to extend the cable, and can be rotatable in a second direction to retract the cable. A workstation can have a control panel, and the workstation can be configured to be deployed from a first configuration to a second configuration. The control panel can be physically inaccessible by an operator when in the first configuration, and can be physically accessible by the operator when in the second configuration.

DETAILED DESCRIPTION

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

Figure 1:
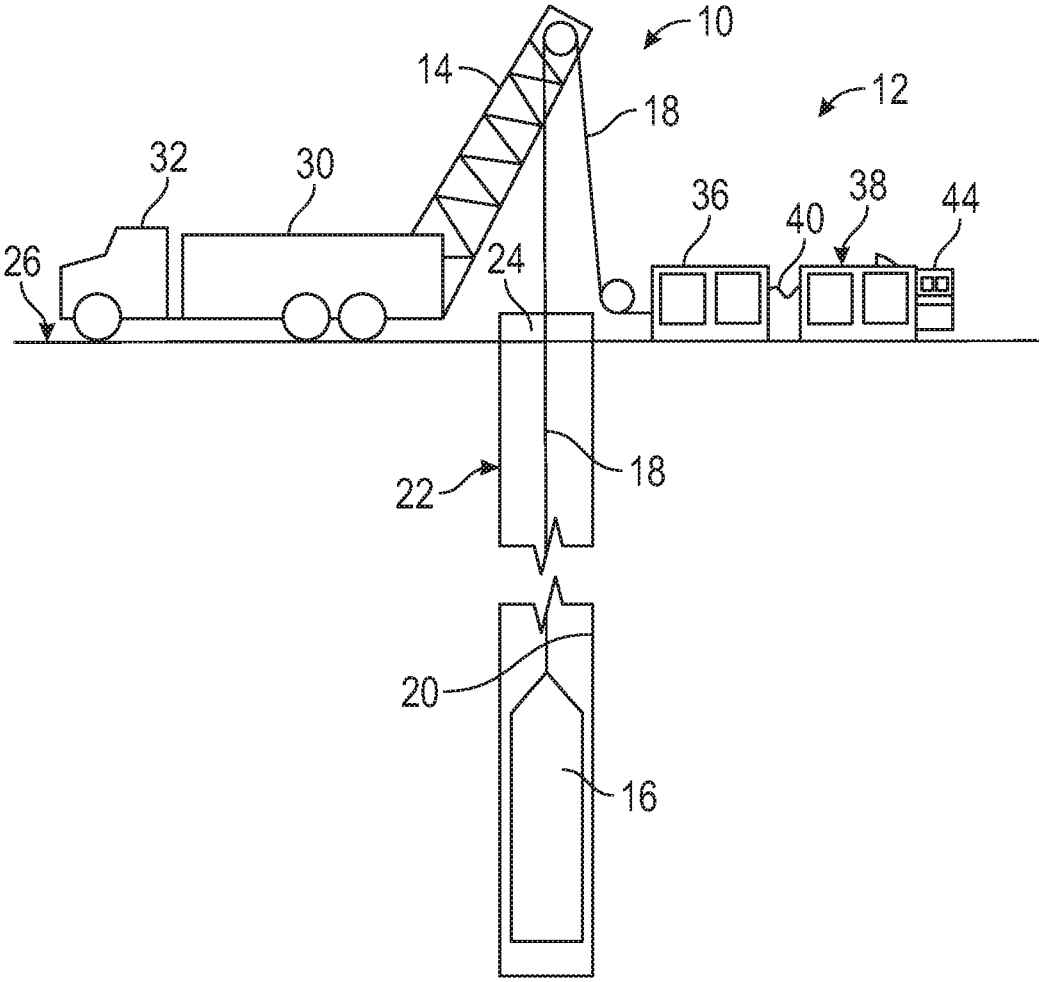
FIG. 1 depicts a schematic elevational view of a wellsite that includes illustrative well servicing surface equipment, according to one or more embodiments described.

FIG. 1 depicts a schematic elevational view of a wellsite 10 that includes illustrative well servicing surface equipment 12, according to one or more embodiments. A mast 14 can be located at the wellsite 10 to raise/lower a downhole tool 16 suspended on a cable 18 in a wellbore 20 of a well 22 at the wellsite 10. The well 22 can include a wellhead 24 at a terminal end of the well 22 at the wellsite surface 26. In some examples, the mast 14 can be part of a crane 30 that can be mounted to a vehicle 32 for moving the mast 14. In other examples the mast 14 can be part of a derrick (not shown).

The surface equipment 12 can include a winch module 36 and a power module 38, both of which can be set on the surface 26 adjacent to the wellhead 24. The winch module 36 can include the cable 18 that can extend from the winch module 36 into the well 22 through the wellhead 24. The power module 38 can generate power and can be connected to the winch module 36 through a power connector 40 to provide power to the winch module 36. The surface equipment 12 can be arranged for offshore operations and/or land based operations. The winch module 36 and the power module 38 can be mounted onto separate frames or can be mounted onto a single frame.

The surface equipment 12 can include one or more integrated workstations 44. For example, the power module 38 can include the integrated workstation 44. In some examples, the power module 38 can include the integrated workstation 44 and the winch module 36 can be free from any integrated workstation 44. In these examples, the winch module 36 can receive power from the power module 38 to power a winch system that can include a drive train, a brake system, a motor, hydraulics, and/or other equipment (not shown).

Figure 2:
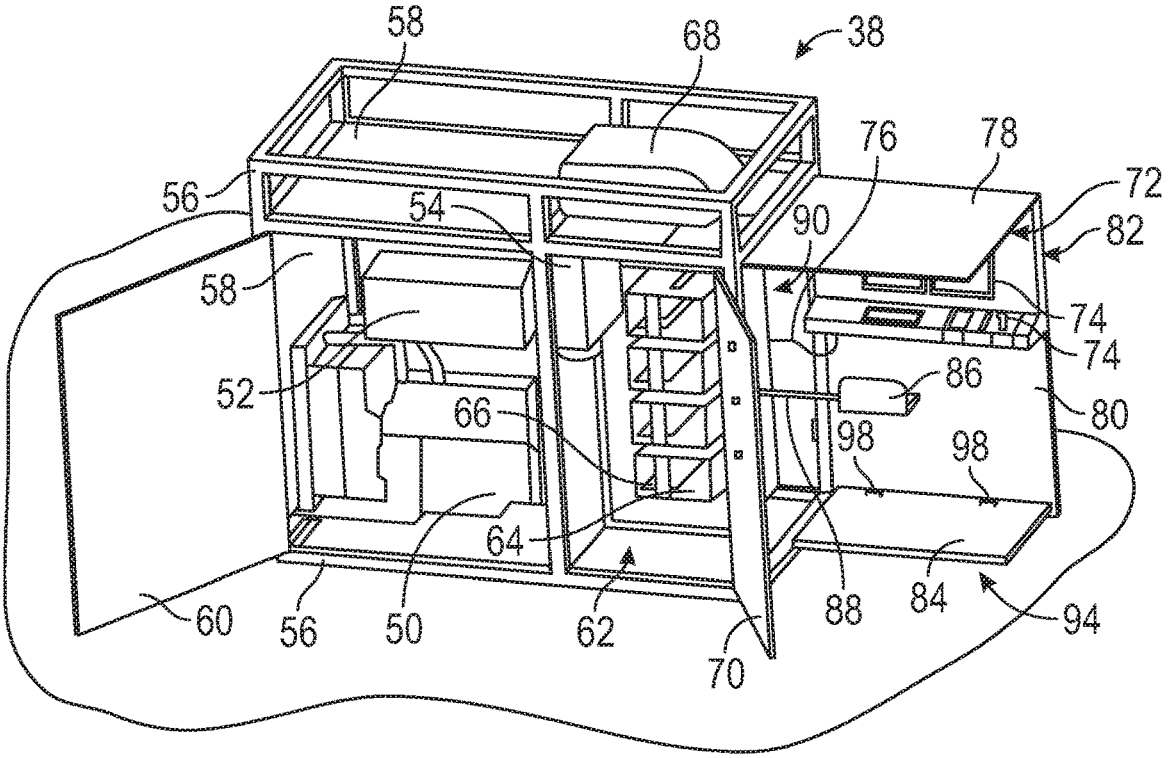
FIG. 2 depicts a perspective view of an illustrative power module shown in FIG. 1 that includes an integrated workstation in a deployed configuration, according to one or more embodiments described.
Figure 3:
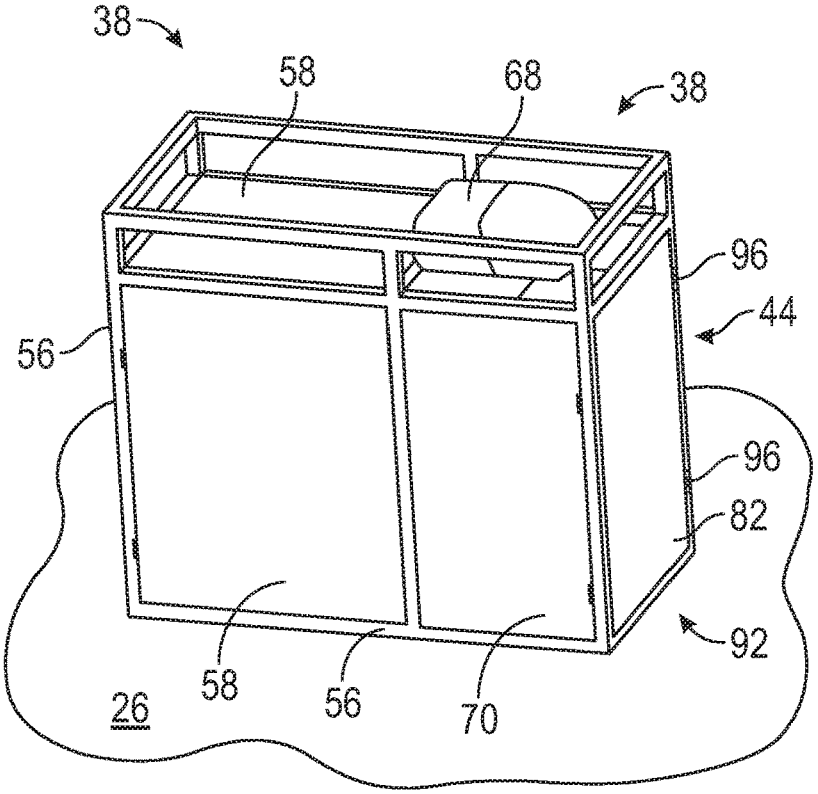
FIG. 3 depicts a perspective view of the power module shown in FIG. 2 with the integrated workstation in a retracted configuration, according to one or more embodiments described.

FIG. 2 depicts a perspective view of the power module 38 shown in FIG. 1 that includes the integrated workstation 44 in a deployed configuration, according to one or more embodiments. FIG. 3 depicts a perspective view of the power module 38 shown in FIG. 2 with the integrated workstation 44 in a retracted configuration, according to one or more embodiments. The power module 38 can include a prime mover 50, such as a diesel engine, a gasoline engine, or an electric engine, which can be connected to a generator 52 for generating electrical power.

In some examples, the prime mover 50, or other power source, such as an electric motor, can also be connected to one or more hydraulic pumps (not shown) for producing hydraulic power. In some examples, the generator 52 and/or hydraulic pump can be connected to the prime mover 50 and/or other power source through a transmission system. The hydraulic pump can be part of a hydraulic system that can include tanks and controls. The power module 38 can be connected to provide power (e.g., electrical and/or hydraulic) to the winch module 36 through the power connector 40. The power module 38 can also provide power to the integrated workstation 44.

The power module 38 can also include a frame 56 that can support one or more panels 58 for enclosing the prime mover 50 and the generator 52. The power module 38 can include one or more access doors 60, which can be opened for accessing the prime mover 50 and generator 52. The access door 60 can be closed (FIG. 3) for enclosing the prime mover 50 and generator 52, and the access door 60 and panels 58 can have sound and/or thermal insulation and can serve to protect the prime mover 50 and generator 52 from weather and the environment around the well 22.

The power module 38 can also include a rack cabinet 62, which can include one or more racks 64 for holding system equipment 66. Illustrative system equipment 66 can include, but is not limited to, acquisition system equipment, e.g., wireline acquisition and/or slickline acquisition equipment; electrical connections, data control; and/or other data acquisition equipment used with well logging tools, such as the downhole tool 16 (FIG. 1).

The power module 38 can also include an electrical distribution panel 54 that can be used for distributing the power to the winch module 36, and to the acquisition systems mounted/installed in the rack cabinet 62, and/or other equipment at the wellsite 10. The rack cabinet 62 can also house the electrical distribution panel 54. Power module 38 can include an environment control system 68, which can be powered from the electrical distribution panel 54. The environment control system 68 can provide cooling, heating, humidity, and/or other environmental control to the interior of the rack cabinet 62 for the system equipment 66. In some examples, the rack cabinet 62 can include an access door 70 and the rack cabinet 62 can be at least partially enclosed, weatherproof, and/or insulated when the access door 70 is closed (FIG. 3) to protect the equipment 66. In some examples, the environment control system 68 can be dedicated to the rack cabinet 62.

As shown in FIG. 2, the integrated workstation 44 can be integrated into the power module 38. The integrated workstation 44 can include a control panel 72, which can include one or more controls 74. The controls 74 can be used to control logging operations, monitoring systems, the winch module 36, the prime mover 50, the generator 52, a hydraulic system, and/or other systems for well servicing operations. In some examples, the controls 74 can be or include direct controls such that an operator can interact physically with the controls. In other examples, the controls 74 can be or include remote controls such that an operator that is not in physical contact with the control panel 72 can manipulate the controls 74, such as, for example, by using a hand held remote at the wellsite 10 or where the operator is located at a remote facility away from the wellsite 10. In other examples, the controls 74 can include direct controls and remote controls. The control panel 72 can be powered by the electrical distribution panel 54 and the control panel 72 can be electrically connected to the distribution panel 54, the system equipment 66, and/or other equipment through one or more umbilicals 76, which can be routed from the control panel 72 into the rack cabinet 62.

The controls 74 can be mounted to an inner surface 80 of a panel 82. The control panel 72 can be part of the inner surface 80 of the panel 82. The integrated workstation 44 can include a floor section 84 upon which the operator can stand while accessing the controls 74. The integrated workstation 44 can also include a seat 86, which can have a support 88 that is connected in a workstation recess 90 for supporting the seat 86. The seat 86 can be moveable to various positions in front of the control panel 72 so that the operator can access the controls 74 while seated on the seat 86. The seat 86 can be retracted into the workstation recess 90 to move the seat 86 out of the way, for example, if the operator wishes to operate the controls 74 while standing. In some examples, if the integrated workstation 44 does not include the floor section 84, the operator can stand on the wellsite surface 26 or other surface to operate the control panel 72.

In some examples, the integrated workstation 44 can include a workstation roof 78. The workstation roof 78 can be positioned and sized to provide cover for an operator while the operator is working at the control panel 72. The roof 78 can provide protection to the control panel 72 and the operator against weather and sun, for example.

In some examples, the integrated workstation 44 can be retracted into a retracted, first configuration 92, as shown in FIG. 3, and deployed from the retracted configuration 92 to a deployed, second configuration 94, as shown in FIG. 2. In the retracted configuration 92, the control panel 72 can be enclosed within the workstation recess 90 and the controls 74 of the control panel can be physically inaccessible by an operator. In the deployed configuration 94, the controls 74 of the control panel 72 can be physically accessible by an operator. The umbilical 76 can maintain the electrical connection to the control panel 72 regardless of whether the integrated workstation 44 is in the deployed configuration 94 or the retracted configuration 92. As shown by comparison, the power module 38 takes a certain foot print area of the wellsite surface 26 when the integrated workstation 44 is in the deployed configuration 94 (FIG. 2), and takes a relatively smaller foot print area of the wellsite surface 26 when the integrated workstation 44 is in the retracted configuration 92 (FIG. 3).

When the integrated workstation 44 is in the retracted configuration 92, the seat 86 can be retracted into the workstation recess 90 so that the panel 82 can be closed and the control panel 72 moved into the workstation recess 90. In some examples, the panel 82 can support the control panel 72. The panel 82 can be supported by hinges 96, which mount to the frame 56 and the panel 82. In this example the panel 82 along with the control panel 72 can rotate about the hinges 96 to close the panel 82.

In some examples, the floor section 84 can be mounted to the panel 82 with hinges 98 so that the floor section 84 can be folded up against the inner surface 80 of the panel 82 when the workstation 44 is in the retracted configuration 92. In some examples, the workstation roof 78 can be in a retracted position (FIG. 3) when the workstation 44 is in the retracted configuration 92 and can be in an extended position (FIG. 2) when the integrated workstation 44 is in the deployed configuration 94. In the deployed configuration 94, the roof 78 can at least partially extend vertically over the control panel 72. In some examples, in the retracted position (FIG. 3), the roof 78 can be in a non-horizontal orientation. For example, in the retracted position the roof 78 can be folded down against the panel 82 or folded down into the workstation recess 90. In some examples, in the retracted position (FIG. 3), the roof 78 can be in a substantially horizontal orientation. For example, in the retracted position the roof 78 can be slid into the frame 56 between the environmental control system 68 and the rack cabinet 62.

The panel 82, the floor section 84, the seat 86, and/or the workstation roof 78 can include one or more electrically, hydraulically, electro-hydraulically, and/or manually driven actuators for deployment and can be supported for movement on slides or other movement supports, which can be integrated in the structure of the power module 38. In some examples, the workstation roof 78 can remain substantially horizontal when retracted and can move linearly by using slides, for example. In some examples, the integrated workstation 44 can be part of another piece of well servicing surface equipment other than the winch module 36 or power module 38. The movement of the integrated workstation 44 between retracted and extended positions can include compliance with designs following health safety executive (HSE) and/or ergonomic requirements.

Figure 4:
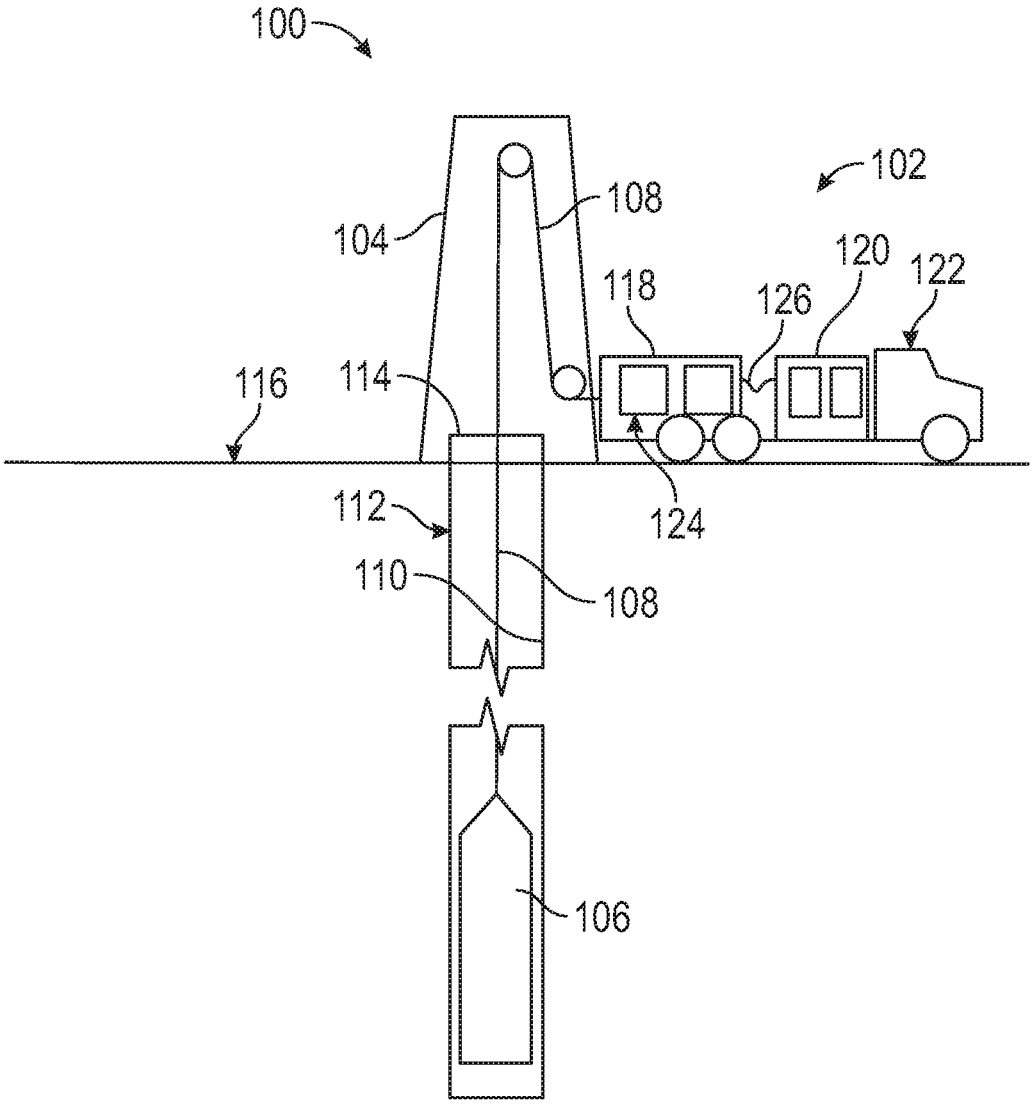
FIG. 4 depicts a schematic elevational view of another wellsite that includes illustrative well servicing surface equipment, according to one or more embodiments described.

FIG. 4 depicts a schematic elevation view of another wellsite 100 that includes illustrative well servicing surface equipment 102, according to one or more embodiments. A mast 104 can be located at the wellsite 100 to raise/lower a downhole tool 106 suspended on a cable 108 in a wellbore 110 of a well 112 at the wellsite 100. The well 112 can include a wellhead 114 at a terminal end of the well 22 at a wellsite surface 116. In some examples, the mast 104 can be part of a crane, which can be mounted to a vehicle for moving the mast 104. In other examples the mast 104 can be part of a derrick or other structure for supporting the downhole tool by the cable 108.

The surface equipment 102 can include a winch module 118 and a power module 120, both of which can be set on the surface 116 adjacent to the wellhead 114, or can be mounted on a vehicle 122, such as, for example a flat-bed truck as shown in FIG. 4. In some examples, the surface equipment 102 can be mounted on separate frames or on a single frame and can be arranged for offshore operations and/or land based operations. The power module 120 can generate power and can be connected to provide power to the winch module 118 using a power connector 126. In some examples, the winch module 118 can include an integrated workstation 124 and the power module 120 can be free from any integrated workstation 124.

Figure 5:
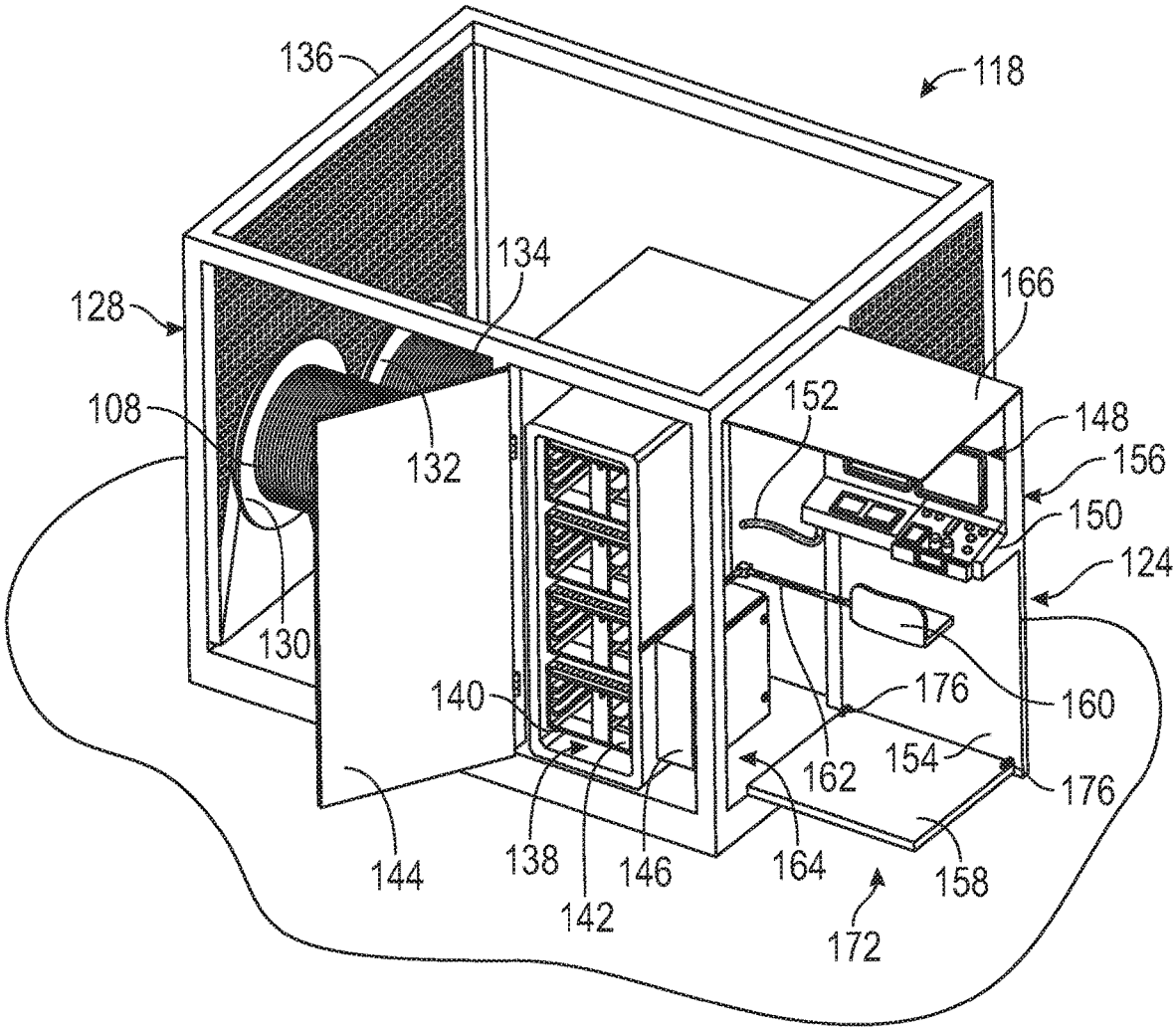
FIG. 5 depicts a perspective view of an illustrative winch module shown in FIG. 4 that includes an integrated workstation in a deployed configuration, according to one or more embodiments described.
Figure 6:
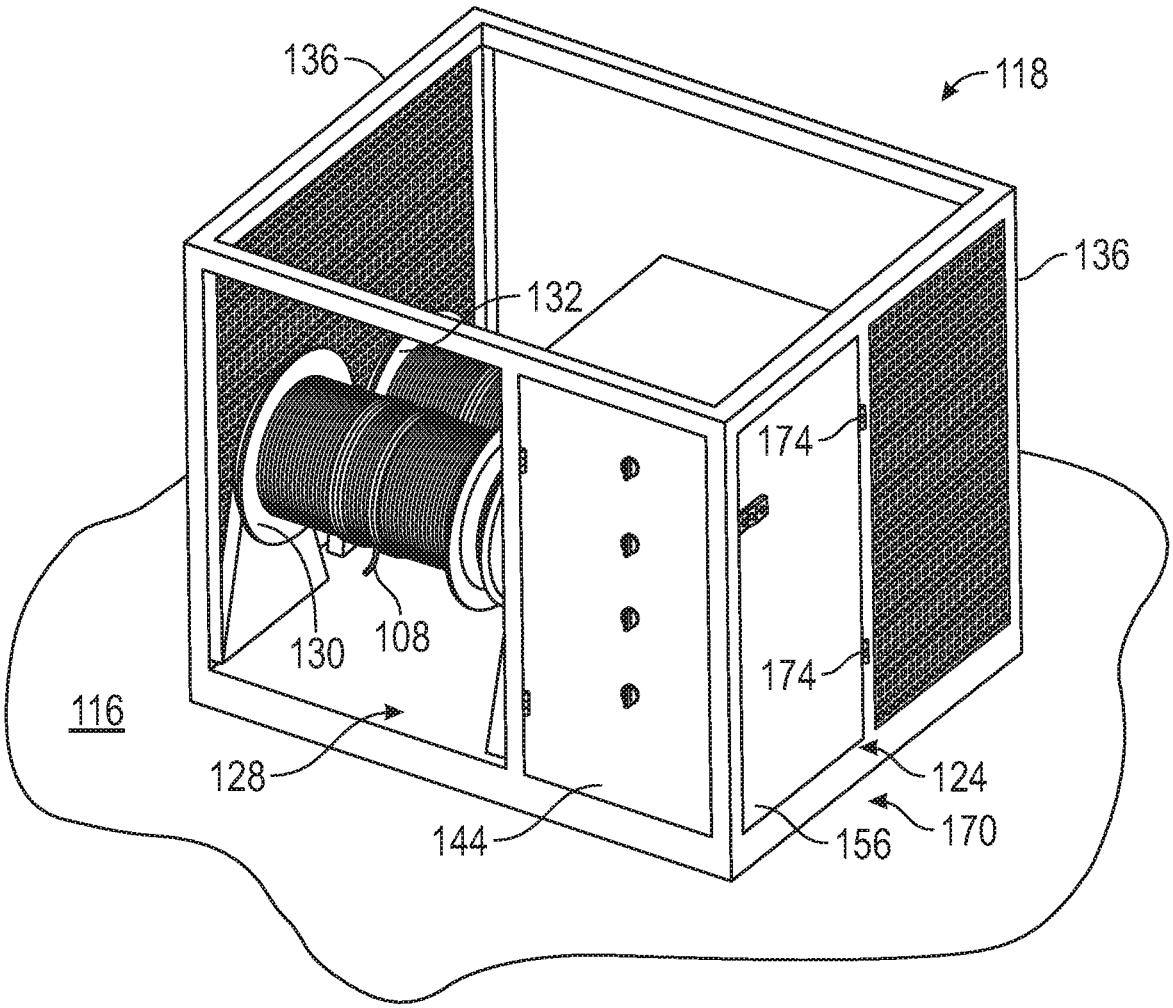
FIG. 6 depicts a perspective view of the winch module shown in FIG. 5 with the integrated workstation in a retracted configuration, according to one or more embodiments described.

FIG. 5 depicts a perspective view of an illustrative winch module 118 shown in FIG. 4 that includes the integrated workstation 124 in a deployed configuration, according to one or more embodiments. FIG. 6 depicts a perspective view of the winch module 118 shown in FIG. 5 with the integrated workstation 124 in a retracted configuration, according to one or more embodiments. The winch module 118 can include a winch 128 that can include cable 108, which can be wrapped around a drum 130. In some examples, the winch 128 can also include a second drum 132, which can include a second cable 134. The cables 108 and 134 can be wireline or slickline cables, or one of each type of cable, or another type of cable. The winch module 118 can include a frame 136 to which the winch 128 can be mounted. The drums 130 and 132 can be used where they are shown or the relative positions of the drums 130 and 132 can be exchanged for use. In another examples, there can be a single drum and single type of cable in the winch module 118. The winch module 118 can also include other components, such as, for example, a drive train, brake system, motor, hydraulics and other components. The winch module 118 can be connected to receive electrical and/or hydraulic power from the power module 120 over power connector 126.

The winch module 118 can include a rack cabinet 138, which can include one or more racks 140 for holding system equipment 142. Illustrative equipment 142 can include, but is not limited to, acquisition system equipment, e.g., wireline acquisition and/or slickline acquisition equipment; electrical connections; data control; and/or other data acquisition equipment used with well logging tools, e.g., the downhole tool 106 (FIG. 4). Winch module 118 can include an environment control system (not shown), which can be powered from the power module 120. The environment control system can be dedicated to the rack cabinet 138 and can provide cooling, heating, humidity and/or other environmental control for the interior of the rack cabinet 138 for the system equipment 142. In some examples, the rack cabinet 138 can include an access door 144 and the rack cabinet 138 can be at least partially enclosed, weatherproof, and/or insulated when the access door 144 is closed (FIG. 6) to protect the equipment 142. The winch module 118 can also include other equipment, such as equipment 146, which can include power distribution, controls, processing equipment, data storage, and/or other equipment.

As shown in FIG. 5, the integrated workstation 124 can be integrated into the winch module 118. The integrated workstation 124 can include a control panel 148, which can include one or more controls 150. The controls 150 can be used to control logging operations, monitoring systems, the winch 128, the power module 120, hydraulics, and/or other systems for well servicing operations. In some examples, the controls 150 can be or include direct controls such that an operator can interact physically with the controls. In other examples, the controls 150 can be or include remote controls such that an operator that is not in physical contact with the control panel 148 can use the controls 150, such as, for example, by using a hand held remote at the wellsite 100 or where the operator is located at a remote facility away from the wellsite 100. In other examples, the controls 150 can include direct controls and remote controls. The control panel 148 can be powered by an electrical distribution panel in the power module 120 and the control panel can be electrically connected to the distribution panel, the system equipment and/or other equipment through one or more umbilicals 152, which can be routed from the control panel 148 into the rack cabinet 138.

The controls 150 can be mounted to an inner surface 154 of a panel 156. The control panel 148 can be part of the inner surface 154 of the panel 156. The integrated workstation 124 can include a floor section 158 upon which the operator can stand while accessing the controls 150. The integrated workstation 124 can also include a seat 160, which can have a support 162 that is connected in a workstation recess 164 for supporting the seat 160. The seat 160 can be moveable to various positions in front of the control panel 148 so that the operator can access the controls 150 while seated on the seat 160. The seat 160 can be retracted into the workstation recess 164 to move the seat 160 out of the way, for example, if the operator wishes to operate the controls 150 while standing. In some examples, if the integrated workstation 124 does not include the floor section 158, the operator can stand on the wellsite surface 116 or other surface to operate the control panel 148.

In some examples, the integrated workstation 124 can include a workstation roof 166. The workstation roof 166 can be positioned and sized to provide cover for an operator while the operator is working at the control panel 148. The roof 166 can provide protection to the control panel 148 and the operator against weather and sun, for example.

In some examples, the integrated workstation 124 can be retracted into a retracted, first configuration 170, as shown in FIG. 6, and deployed from the retracted configuration 170 to a deployed, second configuration 172, as shown in FIG. 5. In the retracted configuration 170, the control panel 148 can be enclosed within the workstation recess 164 and the controls 150 of the control panel 148 can be physically inaccessible by an operator. In the deployed configuration 172, the controls 150 of the control panel 148 can be physically accessible by an operator. The umbilical 152 can maintain the electrical connection to the control panel 148 regardless of whether the integrated workstation 124 is in the deployed configuration 172 or the retracted configuration 170. As shown by comparison, the winch module 118 takes a certain foot print area of the wellsite surface 116 when the integrated workstation 124 is in the deployed configuration 172 (FIG. 5), and takes a relatively smaller foot print area of the wellsite surface 116 when the integrated workstation 124 is in the retracted configuration 170 (FIG. 6).

When the integrated workstation 124 is in the retracted configuration 170, the seat 160 can be retracted into the workstation recess 164 so that the panel 156 can be closed and the control panel 148 moved into the workstation recess 164. In some examples, the panel 156 can support the control panel 148. The panel 156 can be supported by hinges 174, which mount to the frame 136 and the panel 156. In this example the panel 156 along with the control panel 148 can rotate about the hinges 174 to close the panel 156.

In some examples, the floor section 158 can be mounted to the panel 156 with hinges 176 so that the floor section 158 can be folded up against the inner surface 154 of the panel 156 when the workstation 124 is in the retracted configuration 170. In some examples, the workstation roof 154 can be in a retracted position (FIG. 6) when the workstation 124 is in the retracted configuration 170 and can be in an extended position (FIG. 5) when the integrated workstation 124 is in the deployed configuration 172. In the deployed configuration 172, the roof 154 can extend at least partially vertically over the control panel 148. In some examples, in the retracted position, the roof 154 can be in a non-horizontal orientation. For example, in the retracted position the roof 154 can be folded down against the panel 156 or folded down into the workstation recess 164. In some examples, in the retracted position, the roof 154 can be in a substantially horizontal orientation. For example, in the retracted position the roof 154 can be slid into the frame 136 above the rack cabinet 138.

The panel 156, the floor section 158, the seat 160, and/or the workstation roof 154 can include one or more electrically, hydraulically, electro-hydraulically, and/or manually driven actuators for deployment and can be supported for movement on slides or other movement supports, which can be integrated in the structure of the power module 120. In some examples, the workstation roof 154 can remain substantially horizontal when retracted and can move linearly by using slides, for example. In some examples, the integrated workstation 124 may be part of another piece of well servicing surface equipment other than the winch module 118 or power module 120. The movement of the integrated workstation 124 between retracted and extended positions may include compliance with designs following HSE and/or ergonomic requirements.

The integrated workstation can replace a logging cabin and logging operations can be performed with a power module and a winch module, where one of the modules includes the integrated workstation. The integrated workstation, in either the power module or winch module, can be deployed once the module is installed on the surface deck for offshore jobs or once the modules are adapted to a flatbed truck, or other vehicle, and positioned at the wellsite, or otherwise installed at a wellsite. The power module and the winch module (with one having the integrated workstation) can each be mounted to a skid and the two skids can be adapted to a single platform. The single platform can also have an integrated tool rack.

The power module 120 can provide electrical and/or hydraulic power to the winch module 118 and electrical power to the integrated workstation 124. In some examples, the integrated workstation 124 can act as a logging cabin and can include embedded equipment, such as, acquisition systems, oil and gas tooling, the electrical system, the monitoring system, the control command system, electrical and hardware connections for the automation of the winch, and enabling remote operations.

In some examples, the power modules and the winch modules with the integrated workstation can be operated in a land environment and/or an offshore environment, and can operate for slickline and wireline services in both offshore and land environments. The acquisition system(s) can be compliant with the ATEX directive and the IECx standard. In some examples, both the wireline and slickline acquisition systems can be installed into the rack cabinets 62/138, which can include data acquisition equipment for the well logging tools. Examples of wireline acquisition systems can include standard and ATEX eWAFE MONO systems and examples of slickline acquisition systems can include standard and ATEX DTR systems. In some examples, the power and winch modules with an integrated workstation can include electrical systems, such as, electrical cables, and harnesses needed to interconnect equipment together. The workstation control panel can include screens, laptops, tablets, cameras, sensors, programmed logic controllers, transmitters/receivers (e.g., WLAN and/or VSAT systems for example), and/or other equipment for wellsite monitoring and/or servicing.

In some examples, combining slickline and wireline operations, by using the power and winch modules with an integrated workstation, can obviate the need for separate slickline and wireline equipment and crews along with their associated costs, time, on site coordination between the two systems, and/or redundancies. The combined operations can also eliminate additional crane equipment rentals by eliminating the separate logging cabin and associated set-up costs. Utilization of the integrated workstation can reduce the total cost of ownership and/or well servicing by eliminating the logging cabin, eliminating separate dedicated wireline and slickline units, eliminating redundant pressure control equipment for wireline and slickline operations, and/or reducing personnel costs for set-up from four people to one person with an occasional helper. In some examples, the power and winch modules with an integrated workstation can contribute to minimize the footprint occupied by the surface unit on the deck by reducing the number of skids.

Embodiments of the present disclosure further relate to any one or more of the following paragraphs:

1. A process for servicing a well, comprising: placing a winch module adjacent to a wellhead of the well such that a cable of the winch module is extendable into the well; placing a power module adjacent to the wellhead of the well, wherein the power module is configured to provide power to the winch module; and deploying a workstation from a first configuration to a second configuration, wherein the workstation includes a control panel and the control panel is physically inaccessible by an operator when in the first configuration, and wherein the control panel is physically accessible by the operator when in the second configuration.

2. The process according to paragraph 1, wherein the workstation is integrated with and deployed from the winch module.

3. The process according to paragraph 1 or 2, wherein the winch module includes a footprint area and deploying the workstation includes increasing the footprint area of the winch module.

4. The process according to paragraph 1, wherein the workstation is integrated with and deployed from the power module.

5. The process according to paragraph 1 or 4, wherein the power module includes a footprint area and deploying the workstation includes increasing the footprint area of the power module.

6. The process according to any one of paragraphs 1 to 5, wherein deploying the workstation includes moving a roof from a retracted position to an extended position in which the roof is at least partially vertically above the control panel.

7. The process according to any one of paragraphs 1 to 6, wherein deploying the workstation includes moving a seat from a retracted position, to an extended position.

8. The process according to any one of paragraphs 1 to 7, wherein deploying the workstation includes moving a workspace from a retracted position in which the operator is unable to stand on the workspace and access the control panel, to an extended position in which the operator can stand on the workspace and access the control panel.

9. The process according to any one of paragraphs 1 to 8, wherein deploying the workstation includes moving a roof from a retracted position in which the roof is in a non-horizontal orientation to an extended position in which the roof is in at least a substantially horizontally orientation and is at least partially vertically above the control panel.

10. The process according to any one of paragraphs 1 to 9, wherein deploying the workstation includes moving a seat from a retracted position in which the operator is unable to sit in the seat, to an extended position in which the operator can sit in the seat and can access the control panel.

11. A power module comprising: a prime mover; a generator for generating power, the generator connected to the prime mover; and a workstation having a control panel configured to receive power from the generator, wherein the workstation is configured to be deployed from a first configuration to a second configuration, wherein the control panel is physically inaccessible by an operator when in the first configuration, and wherein the control panel is physically accessible by the operator when in the second configuration.

12. The power module according to paragraph 11, wherein the workstation includes a roof that is retracted when the workstation is in the first configuration, and that is deployable to cover at least a portion of the control panel when the workstation is in the second configuration.

13. The power module according to paragraph 11 or 12, wherein the workstation includes a seat that includes a retracted position when the workstation is in the first configuration, and an extended position when the workstation is in the second configuration.

14. The power module according to any one of paragraphs 11 to 13, further comprising a power connection to connect to a winch module having a winch, and wherein the control panel includes controls for controlling the winch.

15. The power module according to any one of paragraphs 11 to 14, wherein the workstation includes a communications connection to a remote control center through which the winch is controllable.

16. The power module according to any one of paragraphs 11 to 15, wherein the power module defines a first footprint area when the workstation is in the first configuration and defines a second footprint area when the workstation is in the second configuration, and wherein the second footprint area is greater than the first footprint area.

17. A winch module, comprising: a cable; a drum around which the cable is disposed, the drum rotatable in a first direction to extend the cable and rotatable in a second direction to retract the cable; and a workstation having a control panel, the workstation configured to be deployed from a first configuration to a second configuration, wherein the control panel is physically inaccessible by an operator when in the first configuration, and wherein the control panel is physically accessible by the operator when in the second configuration.

18. The winch module according to paragraph 17, wherein the workstation includes a roof that is retracted when the workstation is in the first configuration, and that is deployable to cover at least a portion of the control panel when the workstation is in the second configuration.

19. The winch module according to paragraph 17 or 18, wherein the workstation includes a seat that includes a retracted position when the workstation is in the first configuration, and an extended position when the workstation is in the second configuration.

20. The winch module according to any one of paragraphs 17 to 19, further comprising a power connection to receive power from a power module, and wherein the control panel includes controls for controlling the power module.

21. The winch module according to any one of paragraphs 17 to 20, wherein the workstation includes a communications connection to a remote control center through which the winch is controllable.

22. The winch module according to any one of paragraphs 17 to 21, wherein the power module defines a first footprint area when the workstation is in the first configuration and defines a second footprint area when the workstation is in the second configuration, and wherein the second footprint area is greater than the first footprint area.

23. The module according to any one of paragraphs 9 to 22, wherein the workstation includes a roof, which is folded to a non-horizontal orientation when the workstation is in the first configuration, and which is deployable to cover at least a portion of the control panel when the workstation is in the second configuration.

24. The module according to any one of paragraphs 9 to 23, wherein the workstation includes a seat that is in a retracted position in which the operator is unable to sit in the seat when the workstation is in the first configuration, and is in an extended position in which the operator can sit in the seat and can access the control panel when the workstation is in the second configuration.

25. A surface equipment system, comprising: a winch module having a cable and a drum around which the cable is disposed and that is operable to extend and retract the cable; a power module having a prime mover connected to a generator, the power module connected to supply power to the winch module; and a workstation having a control panel for operation by an operator, the control panel connected to receive power from the power module, wherein the workstation is configured to be deployed from a first configuration to a second configuration, wherein the control panel is physically inaccessible by the operator when in the first configuration, and wherein the control panel is physically accessible by the operator when in the second configuration.

26. The surface equipment system according to paragraph 25, further comprising a communication connection to a remote control center through which the winch is controllable.

27. The surface equipment system according to paragraph 25 or 26, wherein the workstation is part of the power module, and wherein the power module defines a first footprint area when the workstation is in the first configuration and defines a second footprint area when the workstation is in the second configuration, and wherein the second footprint area is greater than the first footprint area.

28. The surface equipment system according to any one of paragraphs 25 to 27, wherein the workstation is part of the winch module, and wherein the winch module defines a first footprint area when the workstation is in the first configuration and defines a second footprint area when the workstation is in the second configuration, and wherein the second footprint area is greater than the first footprint area.

29. The surface equipment system according to any one of paragraphs 25 to 28, wherein the workstation partially encloses the operator when in the second configuration.

30. The surface equipment system according to any one of paragraphs 25 to 29, wherein the workstation is open on two sides when in the second configuration.

Although the preceding description has been described herein with reference to particular means, materials, and embodiments, it is not intended to be limited to the particulars disclosed herein; rather, it extends to all functionally equivalent structures, processes, and uses, such as are within the scope of the appended claims. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A process for servicing a well, comprising:

placing a winch module adjacent to a wellhead of the well such that a cable of the winch module is extendable into the well;

placing a power module adjacent to the wellhead of the well, wherein the power module is configured to provide power to the winch module; and deploying a workstation from a first configuration to a second configuration, wherein the workstation includes a control panel and the control panel is physically inaccessible by an operator when in the first configuration, and wherein the control panel is physically accessible by the operator when in the second configuration;

wherein deploying the workstation includes moving a workspace from a retracted position in which the operator is unable to stand on or before the workspace and access the control panel, to an extended position in which the operator can stand on or before the workspace and access the control panel.

2. The process of claim 1, wherein the workstation is integrated with and deployed from the winch module.

3. The process of claim 2, wherein the winch module includes a footprint area and deploying the workstation includes increasing the footprint area of the winch module.

4. The process of claim 1, wherein the workstation is integrated with and deployed from the power module.

5. The process of claim 4, wherein the power module includes a footprint area and deploying the workstation includes increasing the footprint area of the power module.

6. The process of claim 1, wherein deploying the workstation includes moving a roof from a retracted position to an extended position in which the roof is at least partially vertically above the control panel.

7. The process of claim 1, wherein deploying the workstation includes moving a seat from a retracted position, to an extended position.

8. A power module comprising:

a prime mover;

a generator for generating power, the generator connected to the prime mover; and a workstation having a control panel configured to receive power from the generator, wherein the workstation is configured to be deployed from a first configuration to a second configuration, wherein the control panel is physically inaccessible by an operator when in the first configuration, and wherein the control panel is physically accessible by the operator when in the second configuration;

wherein the workstation includes a workspace that includes a retracted position in which the operator is unable to stand on or before the workspace and access the control panel, and an extended position in which the operator can stand on or before the workspace and access the control panel.

9. The power module of claim 8, wherein the workstation includes a roof that is retracted when the workstation is in the first configuration, and that is deployable to cover at least a portion of the control panel when the workstation is in the second configuration.

10. The power module of claim 8, wherein the workstation includes a seat that includes a retracted position when the workstation is in the first configuration, and an extended position when the workstation is in the second configuration.

11. The power module of claim 8, further comprising a power connection to connect to a winch module having a winch, and wherein the control panel includes controls for controlling the winch.

12. The power module of claim 11, wherein the workstation includes a communications connection to a remote control center through which the winch is controllable.

13. The power module of claim 8, wherein the power module defines a first footprint area when the workstation is in the first configuration and defines a second footprint area when the workstation is in the second configuration, and wherein the second footprint area is greater than the first footprint area.

14. A winch module, comprising:

a cable;

a drum around which the cable is disposed, the drum rotatable in a first direction to extend the cable and rotatable in a second direction to retract the cable; and a workstation having a control panel, the workstation configured to be deployed from a first configuration to a second configuration, wherein the control panel is physically inaccessible by an operator when in the first configuration, and wherein the control panel is physically accessible by the operator when in the second configuration;

wherein the workstation includes a workspace that includes a retracted position in which the operator is unable to stand on or before the workspace and access the control panel, and an extended position in which the operator can stand on or before the workspace and access the control panel.

15. The winch module of claim 14, wherein the workstation includes a roof that is retracted when the workstation is in the first configuration, and that is deployable to cover at least a portion of the control panel when the workstation is in the second configuration.

16. The winch module of claim 14, wherein the workstation includes a seat that includes a retracted position when the workstation is in the first configuration, and an extended position when the workstation is in the second configuration.

17. The winch module of claim 14, further comprising a power connection to receive power from a power module, and wherein the control panel includes controls for controlling the power module.

18. The winch module of claim 14, wherein the workstation includes a communications connection to a remote control center through which the winch is controllable.

19. The winch module of claim 14, wherein the power module defines a first footprint area when the workstation is in the first configuration and defines a second footprint area when the workstation is in the second configuration, and wherein the second footprint area is greater than the first footprint area.

* * * * *